US006637174B1

(12) United States Patent
Dietrich et al.

(10) Patent No.: US 6,637,174 B1
(45) Date of Patent: Oct. 28, 2003

(54) DEVICE FOR INSERTING OBJECTS, ESPECIALLY BLISTER STRIPS, INTO FOLDED BOXES

(75) Inventors: Walter Dietrich, Weinstadt (DE); Eberhard Krieger, Weinstadt (DE); Klaus Stoeckel, Korb (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/889,854

(22) PCT Filed: Jan. 12, 2000

(86) PCT No.: PCT/DE00/00080

§ 371 (c)(1),
(2), (4) Date: Nov. 5, 2001

(87) PCT Pub. No.: WO00/43269

PCT Pub. Date: Jul. 27, 2000

(30) Foreign Application Priority Data

Jan. 22, 1999 (DE) ..... 199 02 453

(51) Int. Cl.[7] ..... B65B 1/04; B65B 5/08
(52) U.S. Cl. ..... 53/252; 53/250; 53/251
(58) Field of Search ..... 53/250, 251, 252

(56) References Cited

U.S. PATENT DOCUMENTS 5,323,587 A * 6/1994 Amaranti ..... 53/155
6,047,527 A * 4/2000 Pazdernik et al. ..... 53/447
6,339,910 B1 * 1/2002 Hahnel et al. ..... 53/258
6,453,649 B1 * 9/2002 Kammler et al. ..... 53/473

FOREIGN PATENT DOCUMENTS

GB 1584162 * 2/1981 ..... B65B/61/20

* cited by examiner

*Primary Examiner*—Rinaldi I. Rada
*Assistant Examiner*—Hemant M. Desai
(74) *Attorney, Agent, or Firm*—Ronald E. Greigg

(57) ABSTRACT

An apparatus (10) for inserting blister packs (1) into collapsible cardboard boxes (2) has an inserter (40) and a covering tab (58). During a stationary phase of a first conveyor device (15) that supplies the blister packs (1), the inserter (40) and covering tab (58) transfer the blister packs (1) into the collapsible cardboard box (2) supplied by a second conveyor device (11). In order to be able to execute a format change without replacement of the inserter (40) or adaptation of the covering tab (58), the invention proposes driving the inserter (40) and the covering tab (58) by means of servomotors (32 to 34).

6 Claims, 3 Drawing Sheets

DEVICE FOR INSERTING OBJECTS, ESPECIALLY BLISTER STRIPS, INTO FOLDED BOXES

PRIOR ART

Figure 1:
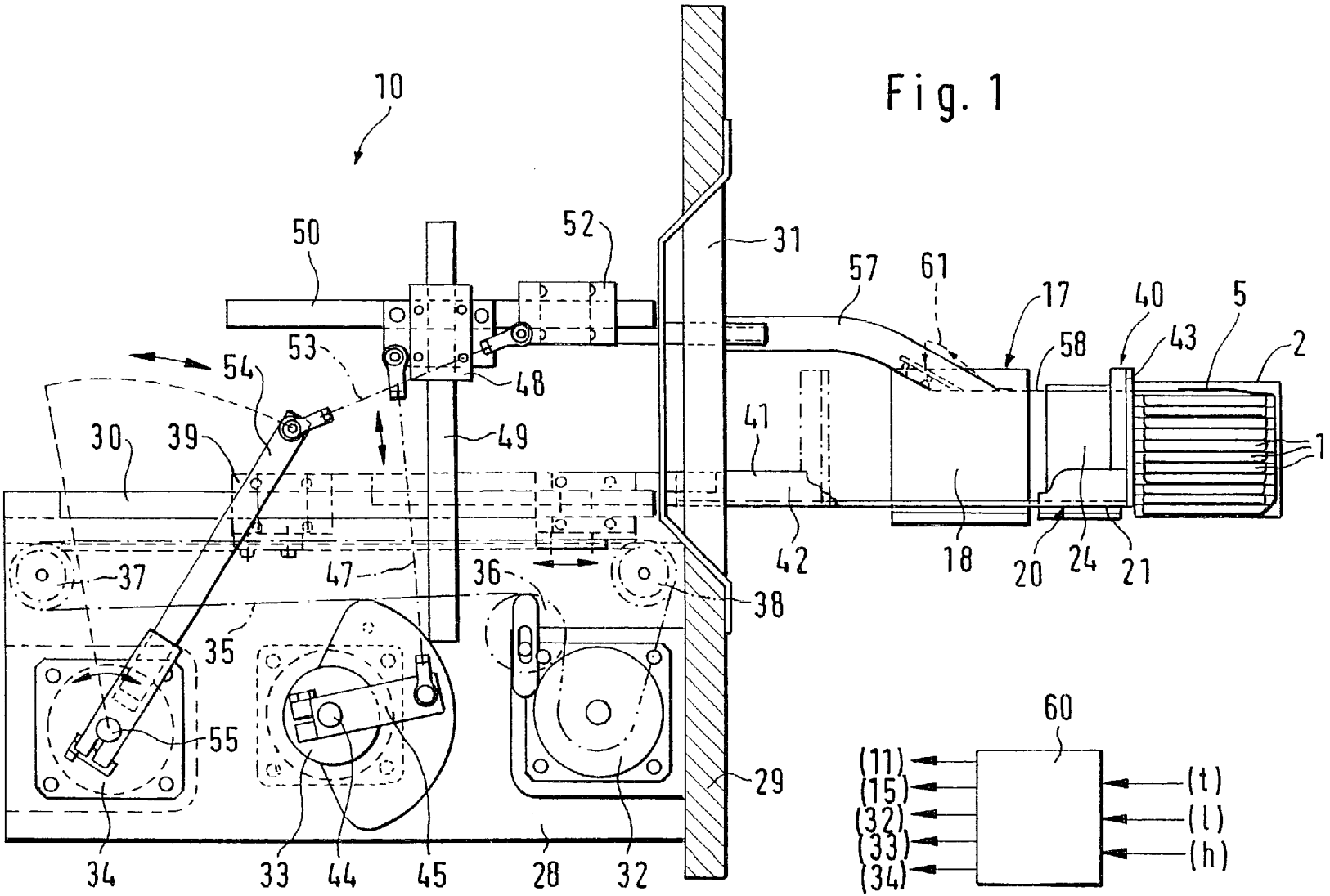

The invention relates to an apparatus for inserting items, in particular blister packs, into collapsible cardboard boxes, according to the preamble to claim 1. In a known apparatus of this type, the movements of the insertion plunger and the covering tab for the blister packs are derived from the rotation of the main shaft of the apparatus, which is embodied as a cartoning machine. This occurs in a mechanical fashion, through the conversion of the rotary motion of the main shaft by means of radial cams and levers into the corresponding horizontal and vertical movements of the insertion plunger and the covering tab. A format change in an apparatus of this kind takes place with a change in length of the collapsible cardboard box or the blister packs through replacement of the insertion plunger. If the number of blister packs to be inserted into the collapsible cardboard boxes changes, then the covering tab height must be readjusted. If a packager processes various collapsible cardboard box formats, then it has to keep in store an insert plunger set for each format and the covering tab must be readjusted each time there is a format change. The known apparatus thus requires a relatively high implementation cost with correspondingly long times during which the machine is off-line during the conversion, particularly if the apparatus has a number of insertion plungers and covering tabs for filling several collapsible cardboard boxes simultaneously. Furthermore, the movement sequences of the insertion plungers and the covering tabs are determined by the transmission mechanics and cannot be adapted to various products, or can only be adapted to them at a high cost. For example, the contacting location and the contacting speed of the covering tab against the uppermost blister pack should be adjustable in the event of a sensitive product or for a particular blister format.

ADVANTAGES OF THE INVENTION

The apparatus according to the invention for inserting items, in particular blister packs, into collapsible cardboard boxes, with the characterizing features of claim 1, has the advantage over the prior art that a format change can take place without changing components on the device. This is achieved by virtue of the fact that by mechanically decoupling the insertion plunger and the covering tab from the main shaft of the cartoning machine and coupling them to at least one servomotor, this servomotor adapts the movements and the adjustment path of the insertion plunger and the covering tab to the format to be processed.

Other advantageous modifications of the apparatus according to the invention for inserting items, in particular blister packs, into collapsible cardboard boxes ensue from the dependent claims. It is particularly advantageous to control each movement of the insertion plunger and the covering tab by means of a separate servomotor. In this case, the movements of the insertion plunger and the covering tab can be variously and optimally adapted to each format.

DRAWINGS

An exemplary embodiment of the invention is shown in the drawings and will be explained in detail subsequently.

Figure 2:
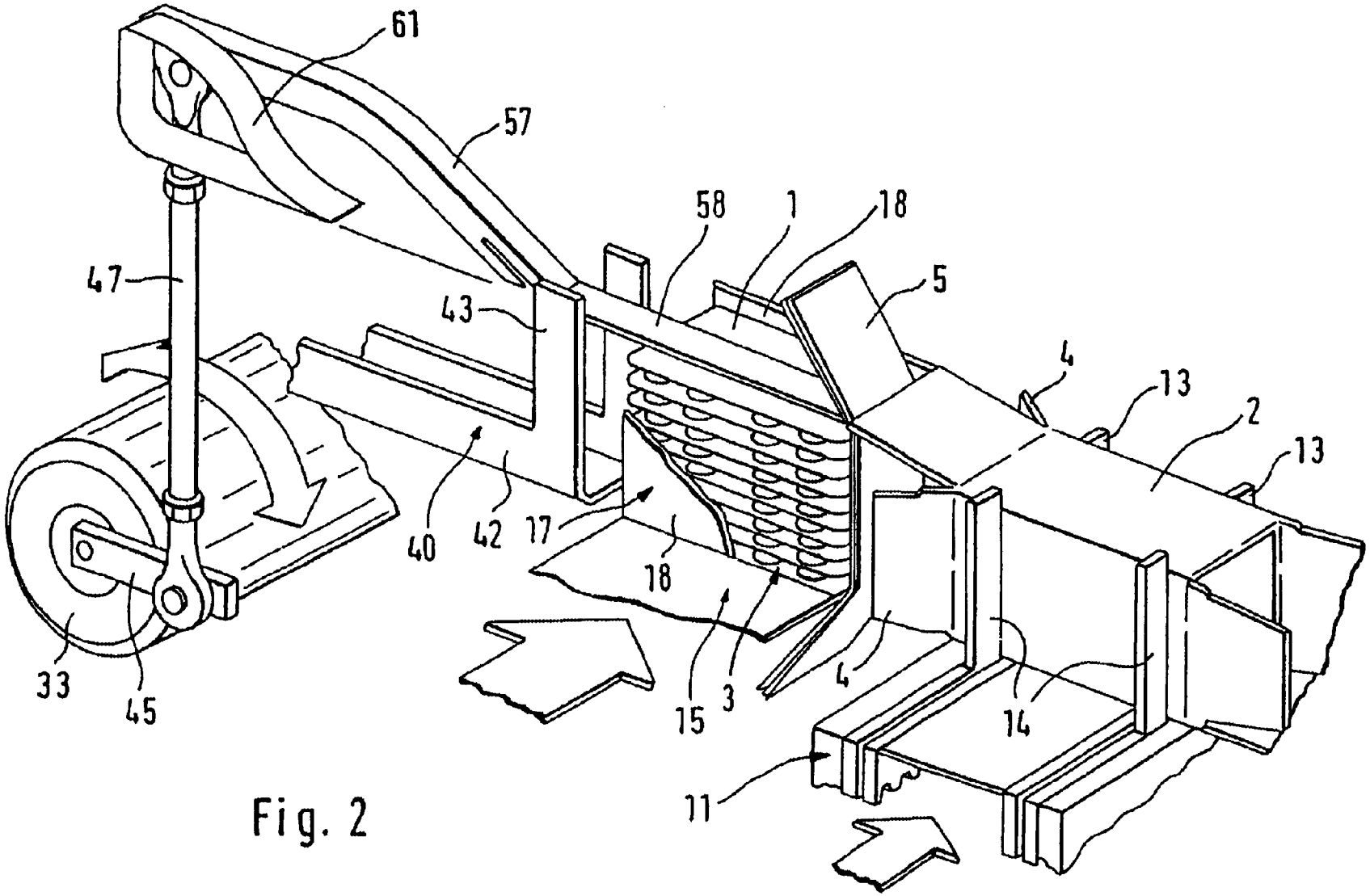
Figure 3:
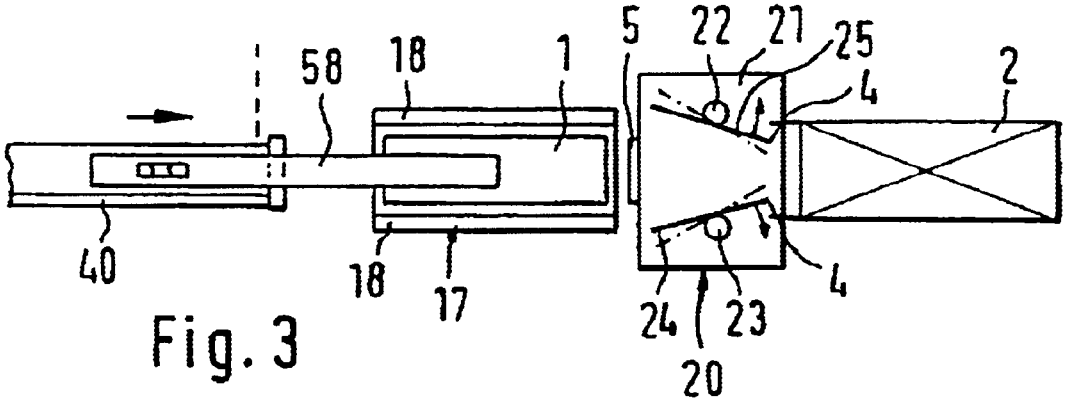
Figure 4:
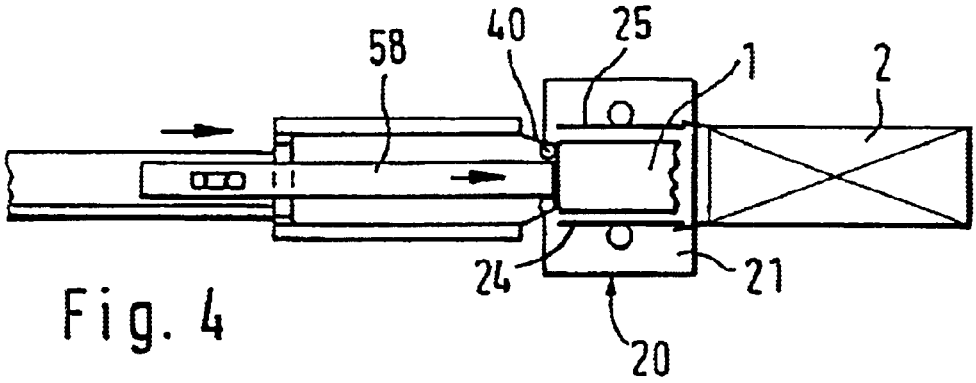
Figure 5:
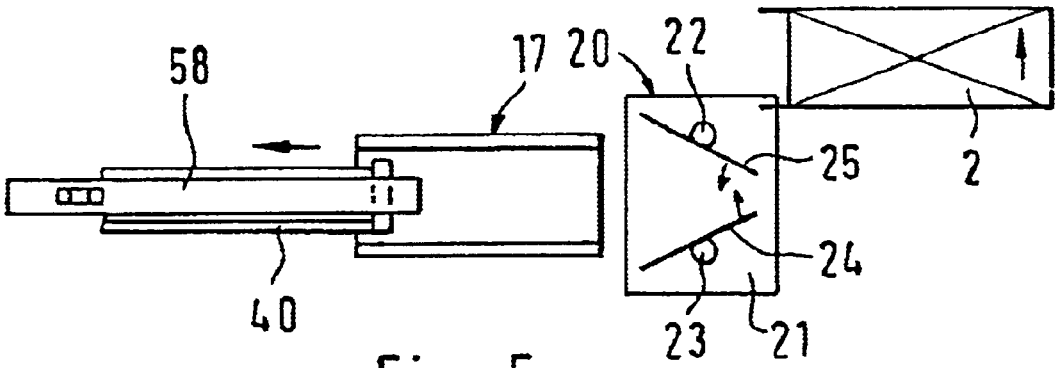

FIG. 1 is a side view of an apparatus for inserting blister packs into collapsible cardboard boxes, in a partially cutaway depiction, FIG. 2 shows part of the apparatus according to FIG. 1, in a partially simplified perspective view, and FIGS. 3 to 5 show simplified top views of the apparatus according to FIG. 2 during different operating phases.

DESCRIPTION OF THE EXEMPLARY EMBODIMENT

The apparatus 10 shown in the Figs. is part of a cartoning machine and is used for inserting blister packs 1 into collapsible cardboard boxes 2. The apparatus 10 has a first, cyclically driven conveyor device 11 for the collapsible cardboard boxes 2, which are disposed between drivers 13, 14, which belong to the first conveyor device 11 and whose distance from each other can be adjusted. Parallel to and spaced apart from the first conveyor device, a second, cyclically driven conveyor device 15 for the blister packs 1 revolves in the same direction as the first conveyor device 11. At its end, the second conveyor device 15 has a cup 17 that is open on its end faces, which respectively contains at least one blister pack 1, but in the exemplary embodiment shown, several blister packs 1 are disposed on top of one another, forming a blister stack 3. The heights of the cup walls 18 and the drivers 13, 14 are adapted to the height of the maximal blister stack 3 to be packaged and/or the height of the highest collapsible cardboard box 2.

An insertion assisting device 20 is fixed in a stationary fashion between the two conveyor devices 11, 15 and is only shown in FIGS. 1 and 3 to 5. It has two plates 24, 25, which are disposed vertically on a transfer plate 21 and can be pivoted around axes 22, 23. When the plates 24, 25 are aligned parallel to each other, they have a distance from each other which approximately corresponds to the distance of the cup walls 18 of a cup 17. Furthermore, the width b and disposition of the plates 24, 25 is such that when the plates 24, 25 are aligned parallel to each other, they engage in the side tabs 4 of the collapsible cardboard boxes 2. Between the insertion assisting device 20 and the second conveyor device 15, there is also an intrinsically known package insert conveyor device that is not shown since it is not essential to the invention, which has a package insert gripper, which readies a package insert 5 for each collapsible cardboard box 2.

On the side of the second conveyor device 15 oriented toward the first conveyor device 11, the apparatus 10 has a bracket 28, which is fastened to the support wall 29 on the side opposite from the conveyor devices 11, 15. Above the bracket 28, the support wall 29 has an opening 31. Three servomotors 32, 33, 34 are fastened to the bracket 28.

The first servomotor 32 drives a toothed belt 35, which turns around three rolls 36, 37, 38 supported on the bracket 28. Between the two rolls 37, 38 that are supported in an upper plane, the toothed belt 35 has a driver 39 attached to it, which can be slid on a horizontally aligned rod 30 and is connected to an inserter 40 that functions as an insertion plunger. The inserter 40 has an essentially horizontal, cross sectionally U-shaped section 41, which passes through the opening 31 of the support wall 29. On the end of the section 41 oriented toward the conveyor devices 11, 15, the vertical wall sections 42 of the section 41 are embodied as raised rectangular strips 43. The height of the strips 43 is adapted to the height of the highest blister stack 3 to be packaged. The length of the section 41 and of the inserter 40 is matched to the adjustment path of the toothed belt 35 between the two rolls 37, 38 in such a way that during the supply phase of the conveyor devices 11, 15, the front end or the strips 43 of the inserter 40 are disposed between the conveyor device 15 for the blister packs 1 and the support wall 29. In the stationary phase of the conveyor devices 11, 15, the front end of the inserter 40 and of the strips 43 just reaches the opening cross section of the collapsible cardboard box 2 in order to insert the blister packs 1 into the collapsible cardboard box 2. This means that the inserter 40 has a width which permits it to be inserted between the cup walls 18 and the two plates 24, 25.

A lever 45 is attached to the drive shaft 44 of the second servomotor 33. The shaft 45 is coupled to a retaining block 48 with a longitudinal bore by means of a first rod 47. A vertically aligned, stationary column 49 is disposed in the longitudinal bore so that the retaining block 48 is guided on the column 49 so that it can move vertically in accordance with the angular position of the lever 45. A horizontally aligned rail 50 is fastened to the retaining block 48 and is encompassed by a carriage 52. The carriage 52 is connected to the drive shaft 55 of the third servomotor 34 by means of a second rod 53 and a pivot lever 54. A tab support 57, which passes through the opening 31 of the support wall 29, is fastened to the carriage 52 and supports a strip-shaped covering tab 58 on its end remote from the carriage 52. The width of the covering tab 58 is such that it can be inserted between the strips 43 of the inserter 40, between the side walls 18 of the cup 17, and between the plates 24, 25.

The three servomotors 32 to 34 can be separately controlled by a control device 60 which is also responsible for controlling the two conveyor devices 11, 15. Among other things, the speed and/or the cycle rate t of the two cyclically operating conveyor devices 11, 15, which determines the output of the cartoning machine 10, the height h of the blister stack 3, and its length l, can be preset in this the control device 60, for example by means of an input keypad. Based on the input values t, h, l, the control unit 60 calculates the necessary movements of the inserter 40 and the covering tabs 58 or their servomotors 32 to 34. Naturally, the movements of the servomotors 32 to 34 can also be already stored in the control device 60 as preset function sequences that can be retrieved depending on the input values t, h, l. These function sequences would therefore have been previously established in the context of trials.

The apparatus 10 operates as follows: the two cyclically driven conveyor devices 11, 15 respectively supply a blister stack 3 and a collapsible cardboard box 2 to the apparatus 10, which come to a stop aligned with the inserter 40 and the covering tab 58. At this point, the inserter 40 is disposed in its retracted end position outside the cup 17 and the covering tab 58 is disposed above the cup walls 18 of the conveyor device 15. Furthermore, the two plates 24, 25, on their ends oriented toward the collapsible cardboard box 2, are pivoted in such a way that when the collapsible cardboard box 2 is supplied, its side tabs 4 at the front in the feed direction of the collapsible cardboard box 2 do not touch the two plates 24, 25. When the conveyor device 11 with the collapsible cardboard box 2 has come to a stop, the two plates 24, 25 are aligned parallel to each other so that the two side tabs 4 of the collapsible cardboard box 2 do not block the opening cross section for the insertion of the blister stack 3. At the same time, the covering tab 58 is lowered onto the top of the blister stack 3 through a corresponding triggering of the second servomotor 33 and the inserter 40 is moved toward the cup 17 through a triggering of the first servomotor 32 (FIG. 3). As soon as the inserter 40 contacts the blister stack 3 and slides it out of the cup 17 toward the collapsible cardboard box 2, the covering tab 58 is also moved horizontally, synchronously with the inserter 40, through a triggering of the third servomotor 34. The synchronous horizontal motion of the inserter 40 and covering tab 58 is required so that there is no relative movement between the individual blister packs 1 in the blister stack 3. When the blister stack 3 is slid out of the cup 17, the front end of the blister stack 3 oriented toward the collapsible cardboard box 2 comes into contact with the package insert 5 readied by the insert gripper. It is essential in this connection that the blister stack 3 always come into contact with the package insert 5 at the same time in relation to the supplying of the package insert, no mater what format is being used. As a result, as shown in FIG. 2, the blister stack 3 always catches the package insert 5, which is supplied perpendicular to the insert direction, at the same point, particularly in the center, so that the package insert is also pushed into the collapsible cardboard box 2. Then, as the transfer of the blister stack 3 continues, it slides along on the transfer plate 21 and is inserted into the opened opening cross section of the collapsible cardboard box 2 (FIG. 4).

In the insertion end position, the covering tab 58 is disposed inside the collapsible cardboard box 2 and the inserter 40 is disposed immediately in front of the open end of the collapsible cardboard box 2 (FIG. 1). No later than when it reaches the insertion end position, the covering tab 58 is first withdrawn horizontally from the interior of the collapsible cardboard box 2 by means of the third servomotor 34. The time for starting to withdraw the covering tab 58 from the collapsible cardboard box 2 can be set depending on the format, where an it must be assured that the covering tab 58 be disposed above the collapsible cardboard box 2 as soon as the conveyor device 11 moves the filled collapsible cardboard box 2 further along its way. The different times for the starting the withdrawal from the collapsible cardboard box 2 result from the different desired cycle rates t and the different set lengths l of the blister packs 1 or of the collapsible cardboard box 2. Generally speaking, the covering tab 58 must be withdrawn from the collapsible cardboard box 2 earlier and/or faster the higher the cycle rate t is (since the stationary time of the conveyor device 11 is then relatively short) and the longer the collapsible cardboard box 2 or the length l of the blister packs 1 is (since the covering tab 58 then protrudes relatively far into the collapsible cardboard box 2). With regard to the inserter 40, with the retraction into its original position by means of the first servomotor 32, it can be advantageous to wait until the covering tab 58 is outside the carton 2. As a result, the possibility of the covering tab 58 pulling blister packs 1 out of the collapsible cardboard box 2 is prevented since the strips 43 of the inserter 40 act as a countersupport.

As shown in FIG. 1, when it is withdrawn from the collapsible cardboard box 2, the covering tab 58 is disposed below the level of the cup walls 18 of the conveyor device 15. Furthermore, the ejector 40 extends through the cup 17. Since the conveyor device 15, in order to prepare the next blister stack 3, can only be moved further when the covering tab 58 is disposed above the cup 17 and the ejector 40 is disposed outside the cup 17, after emerging from the opening cross section of the collapsible cardboard box 2, the covering tab 58 is simultaneously raised to a level above the cup walls 18 by means of the second servomotor 33. By way of explanation, the movement path of the covering tab 58 in FIG. 1 is labeled with the reference numeral 61.

No later than when the inserter 40 and the covering tab 58 are disposed outside the side tabs 4 of the collapsible cardboard box 2, the conveyor device 11 can move the filled collapsible cardboard box 2 onward for further processing. Furthermore, the two plates 24, 25 are then pivoted inward again on the side oriented toward the conveyor device 11 in order to receive the next unfilled collapsible cardboard box 2 (FIG. 5).

As soon as the covering tab 58 is disposed on the level of the cup walls 18 and the inserter 40 is once again disposed outside the cup 17, the conveyor device 15 can also be advanced further in order to supply the next blister stack 3. It is clear from the movement sequences described above that the decisive criterion for the output of the apparatus 10 is that the conveyor device 15 can be advanced further as early as possible in order to supply the next blister stack 3, i.e. that in particular, the inserter 40 is once again disposed outside the cup 17.

With a predetermined collapsible cardboard box format and a desired output, the control device 61 can trigger the servomotors 32 to 34 in such a way that the insertion of the blister stack 3 takes place relatively slowly and therefore gently whereas in particular the retraction of the inserter 40 takes place at a relatively high speed. Consequently, format- and output-dependent speed courses of the inserter 40 and the covering tab 58 are also conceivable, which cannot be achieved with conventional, rigidly mechanical embodiments.

By means of the above described apparatus 10, it is possible to process collapsible cardboard box formats in a range from approximately 50 mm to 150 mm in length and a height of up to approx. 100 mm, without changing or adapting the inserter 40 or covering tab 58, solely through an appropriate triggering of the servomotors 32 to 34.

It should also be noted that in order to increase output, it is naturally also conceivable to provide a number of inserters 40 and covering tabs 58 parallel and rigidly coupled to one another so that a respective number of blister stacks 3 can be inserted simultaneously. In simpler applications, it is also conceivable to use only one or two servomotors instead of three separate servomotors 32 to 34. In this instance, for example, one servomotor is responsible for the entire movement of the covering tab, while its horizontal or vertical motion is then mechanically derived from the respective other motion.

We claim:

1. Apparatus (10) for inserting items into collapsible cardboard boxes (2), the apparatus comprising a cyclically revolving first conveyor device (15) for conveying items to be packaged in a supply direction, a cyclically revolving second conveyor device (11) for conveying collapsible cardboard boxes (2) for receiving the items to be packaged, said second conveyor device disposed parallel to said first conveyer device (15) and operable to convey boxes in said supply direction, an insertion plunger (40) mounted for movement lateral to said supply direction, a covering tab (58) supported for movement up and down and lateral to said supply direction for insertion into and withdrawal from an opening of the collapsible cardboard boxes (2), said insertion plunger (40) and said covering tab (58) being operable to slide the items out of said first conveyor device (15) into the collapsible cardboard box (2) during a stationary phase of said conveyor devices (11, 15) and to be retracted into end positions that do not inhibit the motion of said conveyor devices (11, 15), said insertion plunger (40) being coupled to a first servomotor (32), and said covering tab (58) being coupled to a second servomotor (33) for vertical motion thereby and a third servomotor (34) for horizontal motion thereby, and a control means (60) for storing or calculating format-dependent movement sequences of said insertion plunger (40) and said covering tab (58), said first, second and third servomotors being controlled by said control means (60).

2. The apparatus according to claim 1, wherein said first servomotor (32) drives a toothed belt (35) connected to a carriage (39), said carriage being movable back and forth on at least one guide rod (30) and being connected to the insertion plunger (40).

3. The apparatus according to claim 2, wherein the covering tab (58) is fastened to a carriage (52), which can be moved back and forth on a guide (50) by means of a lever (54) coupled to said third servomotor (34), said guide (50) being supported for movement vertically by means of a support (48) on a column (49), wherein the support (48) is connected to said second servomotor (33) by means of a lever (45).

4. The apparatus according to claim 3, wherein the first, second and third servomotors (32, 33, 34) and said moving mechanism for said insertion plunger (40) and said covering tab (58) are disposed on a common plate (28), said common plate being fastened to a frame (29) of the apparatus (10).

5. The apparatus according to claim 1, wherein the covering tab (58) is fastened to a carriage (52), which can be moved back and forth on a guide (50) by means of a lever (54) coupled to said third servomotor (34), said guide (50) being supported for movement vertically by means of a support (48) on a column (49), wherein the support (48) is connected to said second servomotor (33) by means of a lever (45).

6. The apparatus according to claim 5, wherein the first, second and third servomotors (32, 33, 34) and said moving mechanism for said insertion plunger (40) and said covering tab (58) are disposed on a common plate (28), said common plate being fastened to a frame (29) of the apparatus (10).

* * * * *